US005978986A

United States Patent [19]

Lunow et al.

[11] Patent Number: 5,978,986

[45] Date of Patent: Nov. 9, 1999

[54] PUBLIC CONVENIENCE UNIT

[75] Inventors: Wolfgang Lunow, Bergfelde; Malte Saal, Potsdam; Frank Hoyer, Schöeiche, all of Germany

[73] Assignee: Wall Verkenhrsanlagen GmbH, Berlin, Germany

[21] Appl. No.: 09/155,552

[22] PCT Filed: Apr. 1, 1997

[86] PCT No.: PCT/EP97/01645

§ 371 Date: Sep. 25, 1998

§ 102(e) Date: Sep. 25, 1998

[87] PCT Pub. No.: WO97/37088

PCT Pub. Date: Oct. 9, 1997

[30] Foreign Application Priority Data

Apr. 2, 1996 [DE] Germany ..... 196 13 147

[51] Int. Cl.[6] ..... A47K 4/00

[52] U.S. Cl. ..... 4/664; 4/420

[58] Field of Search ..... 4/662, 663, 664, 4/420

[56] References Cited

U.S. PATENT DOCUMENTS

| | | | |
|---|---|---|---|
| 3,837,011 | 9/1974 | McTighe et al. | 4/662 |
| 5,647,074 | 7/1997 | White | 4/664 |

FOREIGN PATENT DOCUMENTS

| | | | |
|---|---|---|---|
| 0 319 103 | 6/1989 | European Pat. Off. . | |
| 1490029 | 4/1966 | France | 4/664 |
| 2701829 | 9/1994 | France | 4/663 |
| 84 0528 | 6/1952 | Germany . | |
| 72 39814 | 10/1972 | Germany . | |
| 40 06676 | 9/1991 | Germany . | |
| 92 11951 | 11/1992 | Germany . | |
| 0080727 | 3/1990 | Japan | 4/420 |
| 21 23096 | 1/1984 | United Kingdom . | |
| 94 01627 | 1/1994 | WIPO . | |

*Primary Examiner*—Charles E. Phillips
*Attorney, Agent, or Firm*—Paul Vincent

[57] ABSTRACT

A public sanitary cell includes a sanitary compartment accessible through an outer door in which a toilet bowl having a drain is disposed. In order to provide sufficient freedom of motion in front of and next to the toilet bowl, in particular for wheelchair users, while maintaining a compact construction, the toilet bowl can be pivoted by a drive device about a substantially vertical axis, wherein an actuating device is disposed outside of the sanitary cell to operate and control the drive device. The drive device is preferentially operable and controllable by the actuating device only when the outer door is closed and/or when the sanitary compartment is empty.

22 Claims, 5 Drawing Sheets

PUBLIC CONVENIENCE UNIT

BACKGROUND OF THE INVENTION

The invention concerns a public sanitary cell consisting essentially of a sanitary compartment accessible by means of an outer door in which a toilet having a waste drain is disposed.

Public toilets are usually provided in large cities in frequently visited locations and are either accommodated in a building provided therefor or are in the form of erected prefabricated sanitary cells. The sanitary cells are accessible through an outer door opened by insertion of a coin and have completely automatic cleaning devices. When a user leaves the sanitary cell, the outer door is closed and the cleaning process begins. After cleaning is completed, the outer door is automatically unlocked so that the sanitary cell is accessible once more following insertion of a coin. Sanitary cells of this kind have direct local connection to the sewage system at their drain side so that they can usually be operated as autonomous sanitary units and without maintenance.

Public sanitary devices and toilet installations should, in cities, occupy as little space as possible so that, in particular, sanitary cells are extremely compact in construction. On the other hand each user should have sufficient freedom of motion within the sanitary cell. Therefore, e.g. for wheelchair users, a sufficient amount of free motion surface must be provided in front of and next to the toilet or bowl. This clearly legitimate requirement is, however, in conflict with the desire for a very compact configuration of the sanitary cell. Furthermore, the components and devices of public sanitary cells must function in a reliable manner and, in particular, must not present any danger to the user. A technical solution must therefore be found having high safety requirements.

It is the underlying purpose of the invention to create a sanitary cell of the above mentioned kind which has a sufficient amount of space, in particular for wheelchair users, despite its compact construction.

SUMMARY OF THE INVENTION

This purpose is achieved in accordance with the invention in that the toilet bowl is pivotable, by means of a driving unit, about a substantially vertical axis and an actuating device is disposed on the outer side of the sanitary cell to operate and control the drive mechanism.

The pivotable toilet bowl permits a wheel chair user to individually change the position of the toilet bowl so that he can more easily move from the wheelchair onto the toilet bowl without requiring additional space. It has turned out that the required amount of space can be substantially reduced compared to a stationary toilet bowl to facilitate an extremely compact construction while maintaining equal freedom of motion.

The pivotability of the toilet bowl requires additional means for the safety of the user. Towards this end and in accordance with the invention, the toilet bowl is not adjusted manually rather by means of a drive device, e.g. a drive motor. The actuating device with which the drive device is activated to bring the toilet bowl into the desired pivot position is, in the sanitary cell in accordance with the invention, disposed on the outer side preferentially next to the outer door to reliably prevent a user of the sanitary cell from unintentionally pivoting the toilet bowl when seated thereon or when otherwise using the sanitary cell, in particular since the outer door is locked during use.

In order to configure the actuating device for pivoting of the toilet bowl in a manner which is as user friendly as possible, a preferred embodiment of the invention provides for a keyboard with which one of various predetermined positions for the toilet bowl can be selected.

An improper adjustment of the toilet bowl by a user locked within the sanitary compartment can be reliably prevented if the drive device for the toilet bowl can only be operated and controlled by the actuating device when the outer door is closed.

Moreover, in order to prevent other individuals located outside from pivoting the toilet bowl during use of the sanitary cell, the invention may provide that the drive device can only be operated and controlled by the actuating device when the sanitary compartment is empty and not in use. Towards this end, appropriate sensors are disposed in the sanitary compartment which determine the presence of a person and which appropriately block the activating device in this event.

In order to provide the user with an overview of the adjustment possibilities for the toilet bowl and to indicate the current pivot position, a display device for the pivot position of the toilet bowl can be disposed outside of the sanitary cell, preferentially next to the actuating device.

It has turned out to be advantageous if the toilet bowl can be pivoted out of its base position in both pivot directions up to approximately 90° and preferentially up to approximately 75° so that the space located in front of the toilet bowl in the base position is also present sidewardly next to the toilet bowl in the maximum pivot position.

A preferred embodiment provides that the toilet bowl can be locked in differing pivoted positions. This is necessary for a safe and reliable use of the sanitary cell. The locking can either be effected without discrete positions, e.g. using a locking device, or can be stepped. In the latter embodiment, a latching device can be preferentially provided for. If a self-locking geared motor is utilized as a drive device, same can simultaneously serve for fixing the toilet bowl.

In improvements of the invention, the toilet bowl is disposed on a rotatable floor plate which is rigidly connected to the toilet bowl so that a large degree of stability is provided therefor. The floor plate is thereby integrated into the floor of the sanitary compartment while avoiding steps and shoulders.

A waste drain section having an S- or winding shape is normally connected to the toilet bowl to flush out-waste and feeds into a drain waste pipe leading to the sewage system. The waste section can either be fixed in space so that the toilet bowl turns relative thereto or, preferentially, the waste section can pivot along with the toilet bowl. This can, in particular, be achieved when the waste section is inserted into the waste pipe in a pivotable fashion at its lower end, wherein the middle axis of the waste pipe coincides with the vertical pivot axis of the toilet bowl.

In order to simplify use of the sanitary cell by handicapped individuals, the toilet bowl can, in a further improvement of the invention, have a back rest. In order to avoid excessive misalignment between the back rest and the sanitary compartment wall located above same, the back rest can be accommodated, at least in the middle base position of the toilet bowl, within a niche in the sanitary compartment wall, wherein the resting surface of the back rest is preferentially aligned with the portion of the sanitary compartment wall disposed above same to achieve a substantially smoother transition between these two surfaces.

In order to use a public sanitary cell, in particular in the case of physically handicapped people, additional gripping and holding devices, in particular hand rails, are required with which the user can hold and support himself during seating onto the toilet bowl and when standing up. Since, in accordance with the invention, the toilet bowl can assume differing positions relative to its surroundings and in particular, relative to the adjacent walls of the sanitary compartment, in accordance with the invention, a plurality of gripping or holding devices are preferentially provided for which can each be selectively brought into a use or non-use position. Such a gripping and holding device is preferentially a pivotably mounted rail.

Depending on the selected pivot position of the toilet bowl a user can pivot an associated hand rail out of the non-use position in which it is disposed in as space-saving a manner as possible at or in the compartment wall and into the use position so that he can reliably support himself thereon. The gripping and holding device should thereby be capable of being fixed in both the use and non-use positions and preferentially lockable or latchable therein.

In practice it has turned out to be advantageous when the gripping and holding device are configured as frame-like holding brackets which are introduced in a pivotable manner onto the wall of the sanitary compartment via two horizontal bearings disposed at the same height. The horizontal bearings can be relatively far apart to thereby accept bending moments in an advantageous fashion.

For ergonomic reasons, the toilet bowl should be disposed in a niche of the sanitary compartment having a trapezoidal shape in plan view, such that a gripping or holding device is introduced at each of the opposite slanted side surfaces of the niche. In this fashion, the length with which the holding bracket protrudes, in the use position, beyond the sanitary compartment wall can be kept small while effecting an overall high degree of stability for the hold bracketing.

In addition to the above mentioned cleaning of the toilet bowl, following use of the sanitary cell the floor thereof must also be cleaned. This is generally done by introducing water and/or steam under high pressure. In order to assure proper drainage of the water or steam, in accordance with the invention, the floor of the sanitary compartment and/or of the flooring plates inserted therein is slightly tilted, wherein drain grooves can be provided for in the floor of the sanitary compartment or in the inserted floor plates for channeled draining of the water. A particularly simple and effective cleaning of the floor can be achieved in the event that same comprises a plurality of floor sections or plates of which at least some can be pivoted into a vertical position.

Further details and features of the invention can be extracted from the following description of an embodiment with reference to the drawing.

DESCRIPTION OF THE PREFERRED EMBODIMENT

Figure 2:
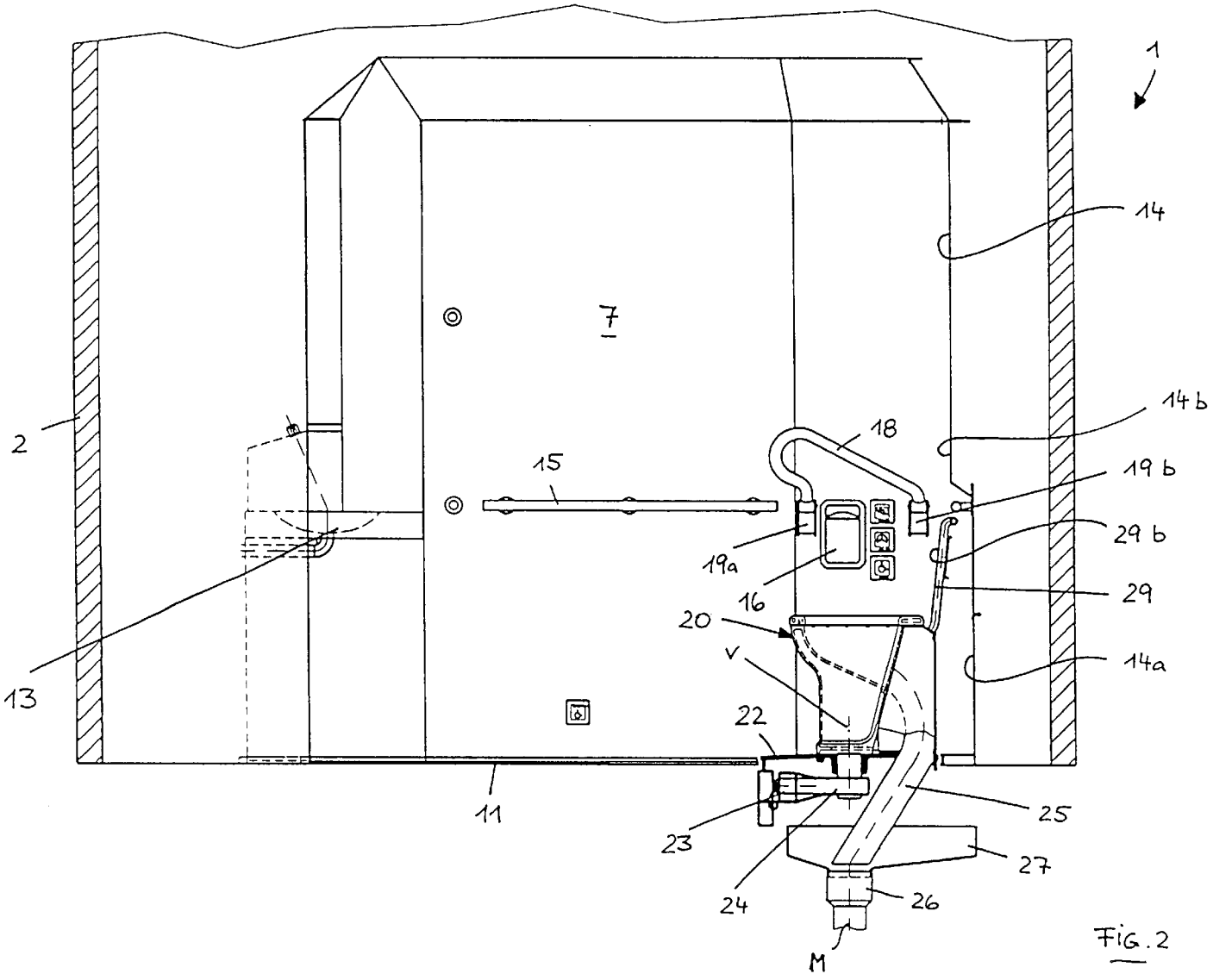
FIG. 2 shows a vertical cut of a sanitary cell in accordance with FIG. 1.
Figure 3:
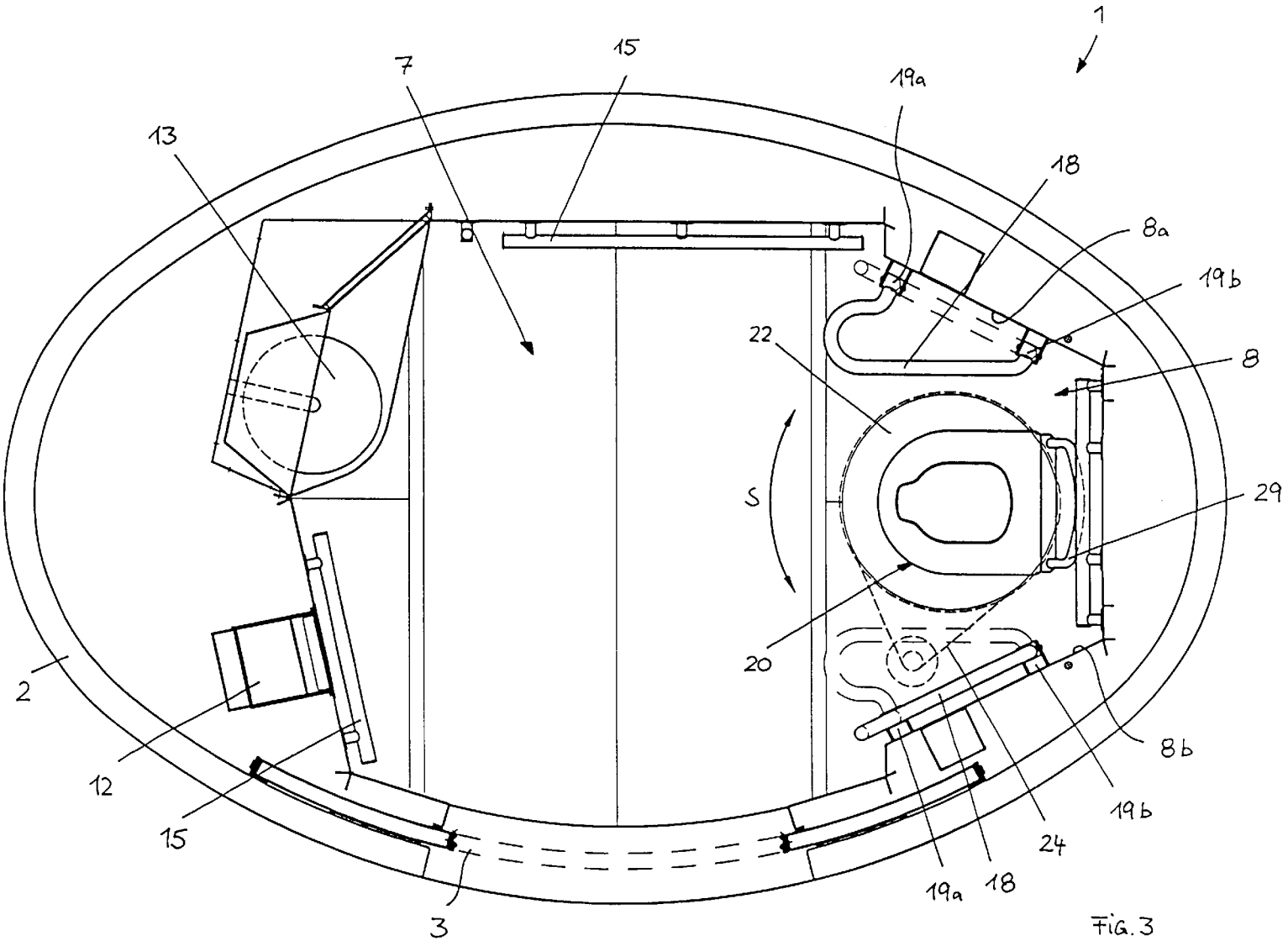
FIG. 3 shows a horizontal cut of the sanitary cell in accordance with FIG. 1.

A sanitary cell 1 shown in the figures comprises an outer housing 2 containing an inner sanitary compartment 7, which can be closed by an outer sliding door 3. A conventional paper dispenser 16, sink 13, garbage pail 12, and toilet bowl 20 are disposed within the sanitary compartment 7. Hand rails 15 on the side walls 14 of the sanitary compartment 7 provide support, particularly for fragile or handicapped people. As shown in FIG. 3, the toilet bowl 20 is disposed in a niche 8 of the sanitary compartment 7 having a trapezoidal plan view, wherein a holding bracket 18 is provided proximate the toilet bowl 20 at each of the opposite slanting side walls 8*a*, 8*b* of the niche 8, each of which is borne by two horizontal pivot bearings 19*a*, 19*b* disposed at the same height on the inner side wall 14 of the sanitary compartment 7. The holding brackets 18 can be pivoted out of the non-use position (shown in FIG. 2), at which they are fixed and preferentially latched in a vertical direction adjacent to the side wall 14, into a use position in which they horizontally protrude into the sanitary compartment 7 (FIG. 3).

The toilet bowl 20 is firmly mounted to a floor plate 22 in the floor 11 of the sanitary compartment 7 which can pivot about a vertical axis V. The pivot motion is initiated by a motor 23 whose drive motion is transferred to the floor plate 22 by a transmission or a toothed belt 24.

The toilet bowl 20 has a vertically projecting back rest 29 at its rear side which is disposed in a niche 14*a* of the side wall 14 of the sanitary compartment 7 so that a resting surface 29 is aligned with a section 14*b* of the side wall 14 of the sanitary compartment 7 located above same to avoid large steps.

A waste section 25 is introduced on the toilet bowl 20 curving around the pivot drive and leading via an intermediate catch tub 27 into a vertical waste pipe 26 connected to the sewage system. The waste section 25 is firmly connected to the toilet bowl 20 and can be pivoted relative to the waste pipe 26 together therewith, wherein the middle axis M of the waste pipe 26 coincides with the vertical pivot axis V of the base plate 22.

Figure 1:
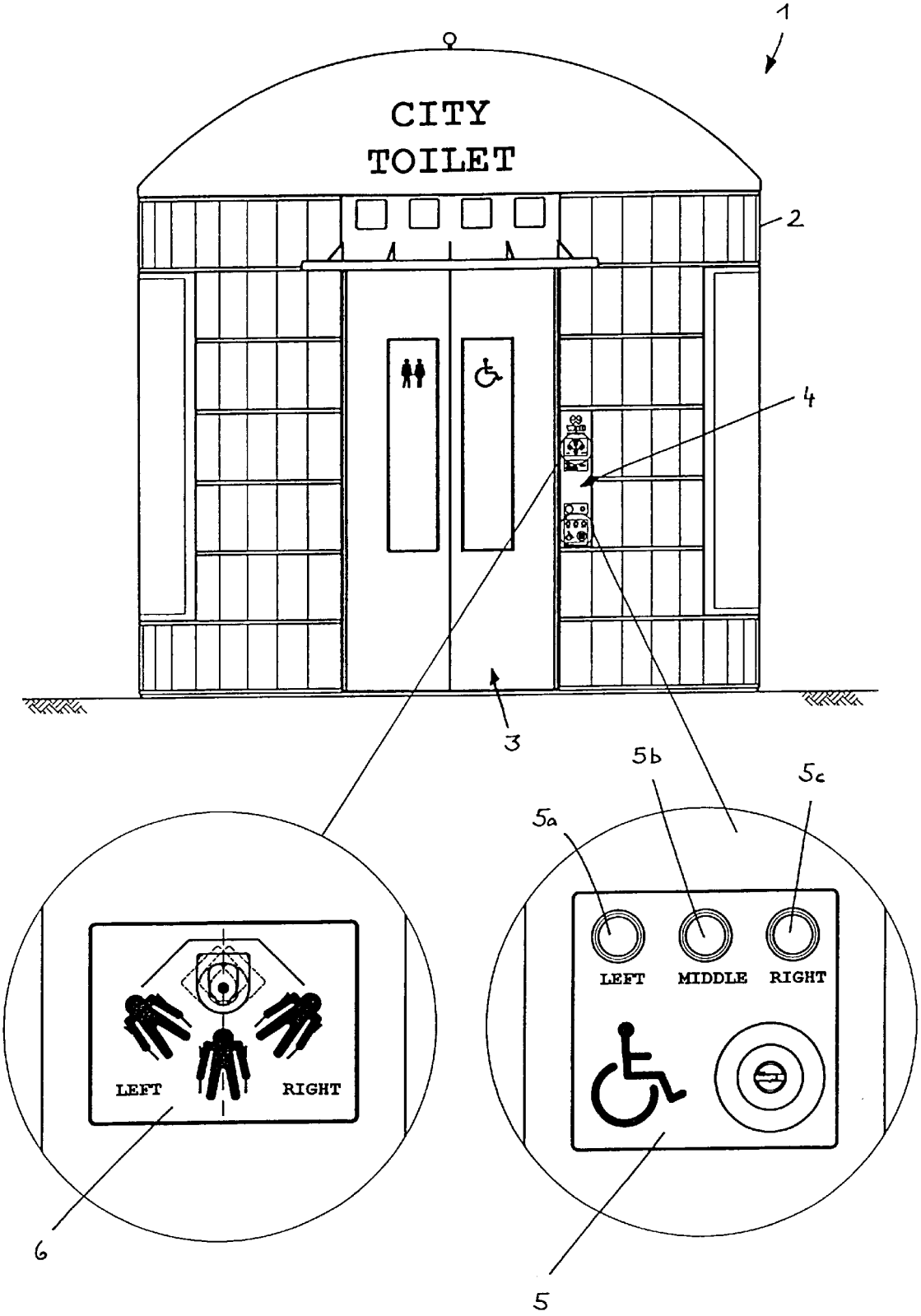
FIG. 1 shows an outside view of a sanitary cell having a detail of the actuating device and the display device.

As shown in FIG. 1, an operation unit 4 is disposed on the outer side of the sanitary cell 1 proximate the outer sliding door 3 having an actuating device 5 for activating and controlling the drive motor 23 as well as a display device 6. The actuating device 5 comprises three buttons 5*a*, 5*b*, and 5*c*, wherein the middle button 5*b* brings the toilet bowl 20 into the middle base position shown in FIG. 3 and the buttons 5*a* and 5*c* bring the toilet bowl into the right and left pivot positions respectively, these positions being shown in FIGS. 3*a* and 3*b* respectively. The user can read-off the current pivot position of the toilet bowl 20 from the display device 6.

Figure 3A:
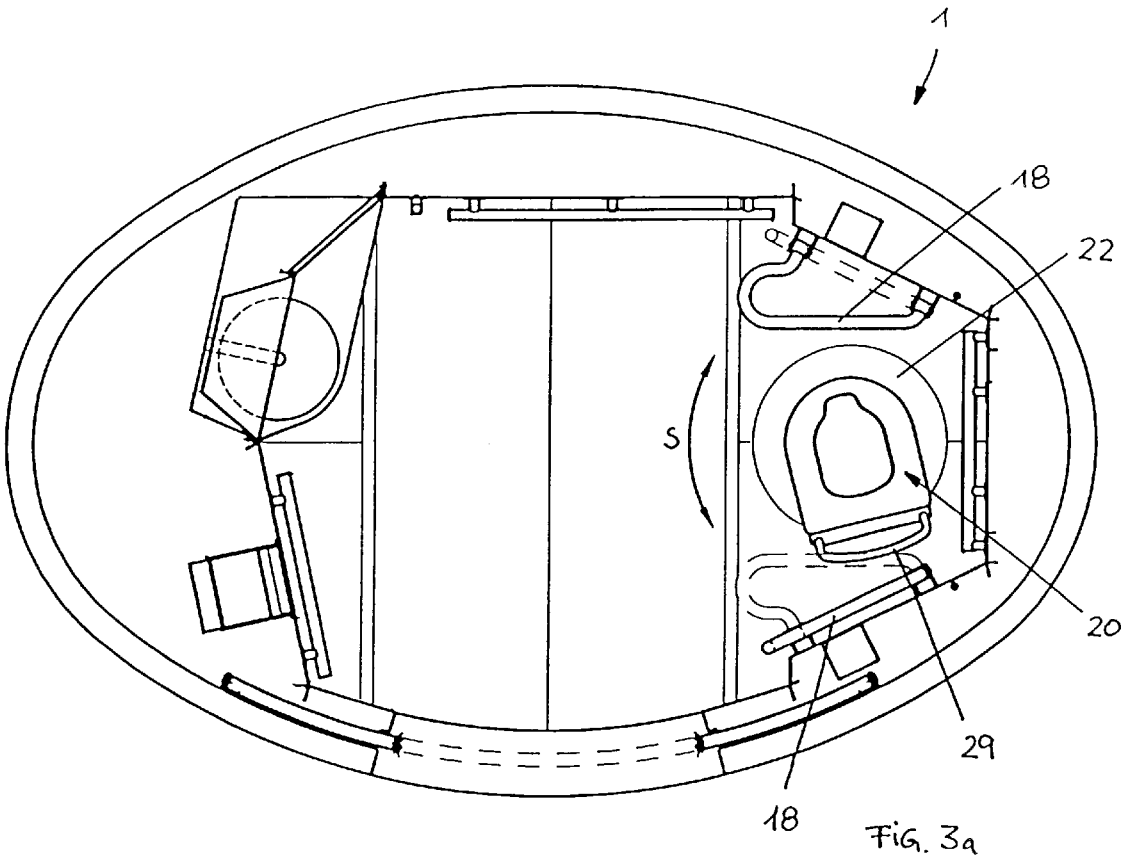
FIG. 3*a* shows the sanitary cell of FIG. 3 in a first position for the toilet bowl.
Figure 3B:
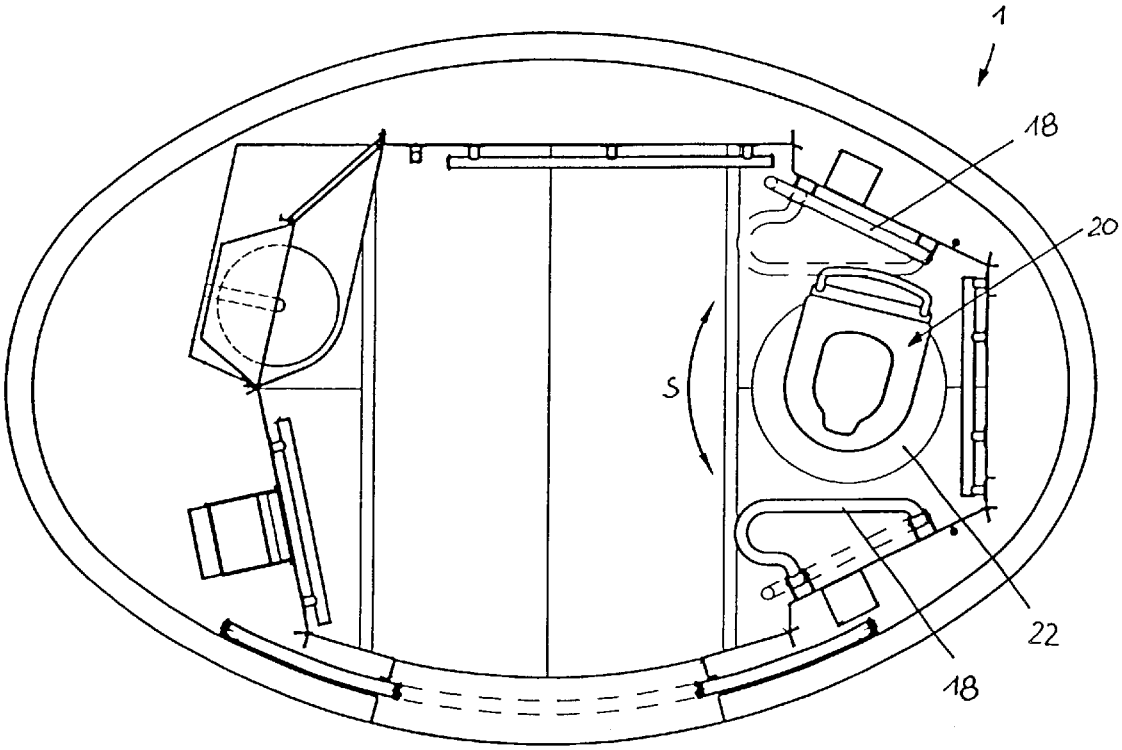
FIG. 3*b* shows the sanitary cell of FIG. 3 in a second position for the toilet bowl.

The sanitary cell 1 is configured in such a fashion that a pivoting of the toilet bowl 20 through operation of one of the buttons 5*a*, 5*b* or 5*c* can only take place if the sliding door 3 is closed and if, in addition, the sanitary compartment 7 is empty. Towards this end, sensors (not shown) are provided for which issue appropriate state signals to a control device, wherein the control device then blocks the actuating device 5 if the previously mentioned conditions are not fulfilled. As shown in FIG. 3, e.g. a wheelchair user has a sufficient amount of room in the sanitary compartment 7 in front of the toilet bowl 20 after opening the sliding door 3 to facilitate his mobility. Prior to entering into the sanitary compartment, the user has pivoted the toilet bowl 20 through activation of the motor 23 into one of the pivot directions indicated by the double arrow S until the desired pivot position (FIG. 3*a* or 3*b*) has been obtained. In the embodiment shown, the pivot angle between the middle base position and the maximum pivot positions assumes a value of approximately 75°. When the toilet bowl 20 with the base plate 22 has reached the desired pivot position, it is held at this location by a self-locking motor 23. The user can then swing down one of the holding brackets 18 out of the non-use position (FIG. 3, lower illustration) into the use position (FIG. 3, upper illustration), wherein a locking mechanism is also provided for when the use position has been reached. FIGS. 3*a* and 3*b* show that there is a sufficient amount of space for a wheelchair user in the pivoted position proximate the toilet bowl 20 to move the wheelchair next to the toilet bowl 20 and to move onto the toilet bowl.

After the user has left the sanitary compartment 7, the sliding door 3 automatically closes and a conventional cleaning process follows with which, in addition to the toilet bowl 20, the floor 11 of the sanitary compartment 7 is cleaned with water or steam.

Figure 4:
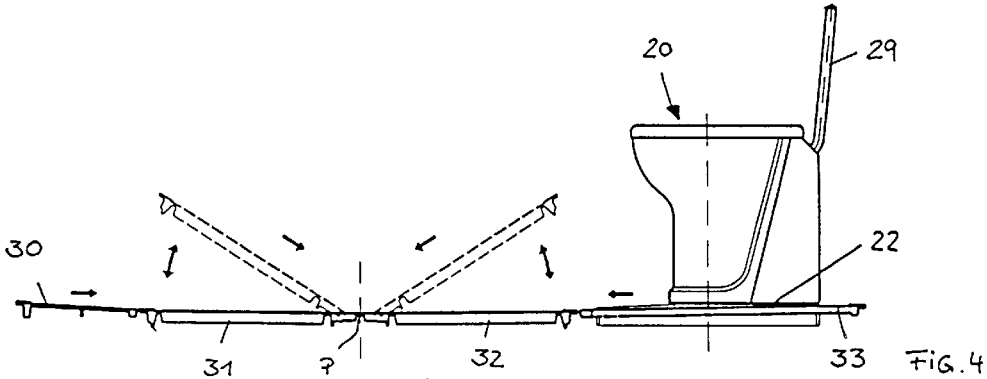
FIG. 4 shows the floor of the sanitary cell in a folded-up position and FIG. 5 shows a plan view of the sanitary cell floor.

As shown in FIG. 4, the floor 11 of the sanitary compartment 7 and the floor plates 22 provided therein are slightly tilted in the direction of a horizontal axis P so that a defined draining of the cleaning liquid is achieved. This is supported by drain grooves 28 substantially covering the surface of the upper side of the floor 11 and extending substantially perpendicular to the axis P, i.e. in the tilt direction. The circular floor plate 22 also has corresponding drain grooves 28 extending in the radial direction.

Figure 5:
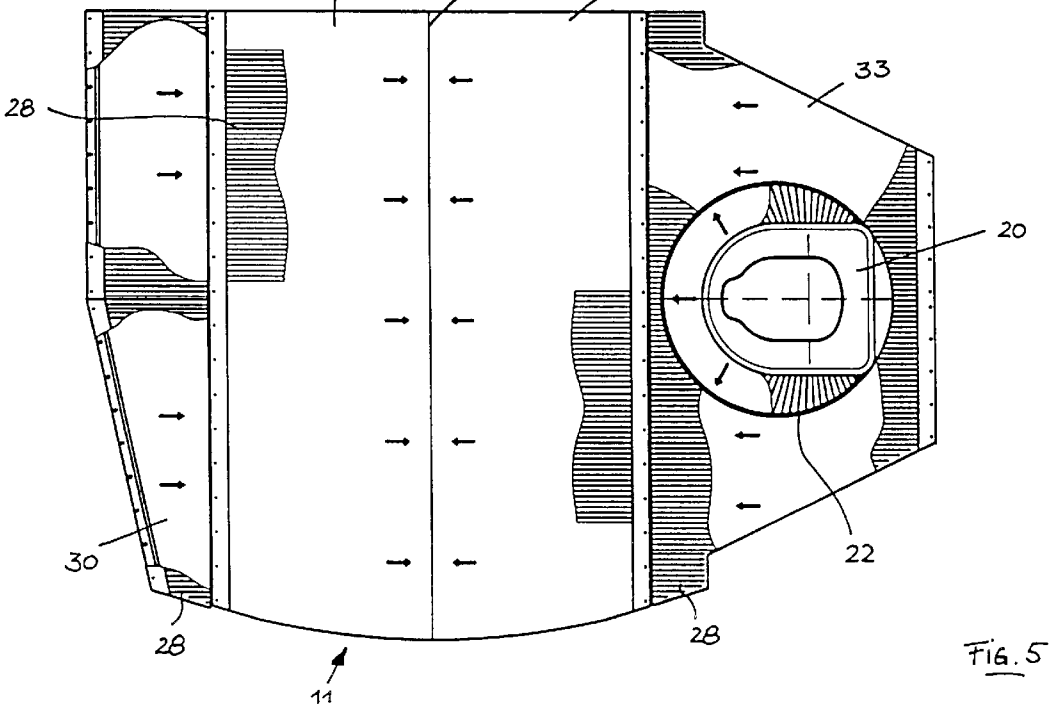

In accordance with FIG. 5, the floor 11 of the sanitary compartment 7 comprises a plurality of floor sections 30, 31, 32 and 33 each formed from corresponding floor plates, wherein the floor plates 31 and 32 adjacent to the axis P can be pivoted about the axis P into a raised position shown in FIG. 4 for cleaning so that the cleaning fluid or the water drains very rapidly from the floor plates 31 and 32 to shorten the time necessary for the cleaning process.

We claim:

1. A public sanitary cell having an outer door, the cell comprising:

a sanitary compartment having a floor and walls;

a toilet bowl having a drain and disposed within said compartment;

a drive and locking apparatus cooperating with said toilet bowl to pivot said toilet bowl about a substantially vertical axis from a base position in a first direction and in a second direction opposite said first direction and to fix said toilet bowl in differing pivot positions; and an actuating device disposed outside the sanitary cell and communicating with said drive and locking apparatus to actuate and control said drive and locking apparatus for selecting one of various positions for said toilet bowl, whereby said actuating device adjusts and adapts components disposed within said sanitary compartment to needs of handicapped individuals by creating a toilet facility accessible to a wheel chair from both sides.

2. The sanitary cell of claim 1, wherein said actuating device consists essentially of a keyboard.

3. The sanitary cell of claim 1, wherein said drive and locking apparatus can be operated and controlled by said actuating device only when the outer door is closed.

4. The sanitary cell of claim 1, wherein said drive and locking apparatus can be operated and controlled by said actuating device only when said sanitary compartment is empty.

5. The sanitary cell of claim 1, further comprising a display device of pivot positions of said toilet bowl, said display device disposed outside the sanitary cell.

6. The sanitary cell of claim 1, wherein said drive and locking device comprises a self-locking motor.

7. The sanitary cell of claim 1, further comprising a rotatable base plate upon which said toilet bowl is disposed.

8. The sanitary cell of claim 1, wherein said toilet bowl can be pivoted out of said base position into both of said first and said second directions through a maximum pivot angle of up to approximately 90°.

9. The sanitary cell of claim 8, wherein said maximum pivot angle is approximately 75°.

10. The sanitary cell of 1, wherein said drain comprises a waste section which feeds into a substantially vertical waste pipe, wherein said waste section can be pivoted along with said toilet bowl.

11. The sanitary cell of claim 10, wherein said waste section can pivot within said waste pipe and a middle axis of said waste pipe coincides with said substantially vertical axis.

12. The sanitary cell of claim 1, wherein said toilet bowl comprises a back rest.

13. The sanitary cell of claim 12, wherein said back rest is disposed in a niche of a sanitary compartment wall in said base position of said toilet bowl.

14. The sanitary cell claim 12, wherein a resting surface of said back rest is aligned with a section of a sanitary compartment wall disposed above said back rest.

15. The sanitary cell of claim 1, further comprising a first gripping and holding device having a use and a non-use position, said gripping and holding device disposed proximate said toilet bowl.

16. The sanitary of claim 15, wherein said first gripping and holding device can be fixed in said use and said non-use positions.

17. The sanitary cell of claim 15, wherein said first gripping and holding device comprises a frame-like holding bracket borne for pivoting.

18. The sanitary cell claim 17, wherein said holding bracket is borne for pivoting by two horizontal bearings disposed at a same height on a wall of said sanitary compartment.

19. The sanitary cell of claim 15, wherein said sanitary compartment comprises a niche having a trapezoidal plan view with said toilet bowl disposed in said niche and further comprising a second gripping and holding device having a use and non-use position, said first gripping and holding device disposed on a first slanting side wall of said niche, and said second gripping and holding device disposed on a second slanting side wall of said niche opposite said first slanting side wall.

20. The sanitary cell of claim 1, wherein said floor comprises a tilted floor section.

21. The sanitary cell of claim 1, wherein said floor has drain grooves.

22. The sanitary cell of claim 1, wherein said floor consists essentially of a plurality of floor sections of which at least one can be pivoted into a raised position.

* * * * *